US009605424B2

(12) United States Patent
Bikker

(10) Patent No.: US 9,605,424 B2
(45) **Date of Patent: *Mar. 28, 2017**

(54) TRANSPORTABLE SANITARY UNIT

(71) Applicant: Marcel Adriaan Dirk Bikker, Dordrecht (NL)

(72) Inventor: Marcel Adriaan Dirk Bikker, Dordrecht (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/180,967

(22) Filed: Jun. 13, 2016

(65) Prior Publication Data

US 2016/0298347 A1 Oct. 13, 2016

Related U.S. Application Data

(63) Continuation of application No. 14/714,692, filed on May 18, 2015, now Pat. No. 9,366,019, which is a continuation of application No. 13/833,174, filed on Mar. 15, 2013, now Pat. No. 9,060,652.

(51) Int. Cl.

| | |
|---|---|
| ***E04H 1/12*** | (2006.01) |
| ***E04B 1/343*** | (2006.01) |
| ***A47K 4/00*** | (2006.01) |
| ***E03D 7/00*** | (2006.01) |
| *E04H 1/00* | (2006.01) |
| *A47K 11/04* | (2006.01) |

(Continued)

(52) U.S. Cl.

CPC ..... *E04B 1/34336* (2013.01); *A47K 4/00* (2013.01); *E03D 7/00* (2013.01); *E04H 1/1216* (2013.01); *E04B 2001/34394* (2013.01); *E04H 2001/1283* (2013.01)

(58) Field of Classification Search

CPC ..... A47K 4/00; E03D 7/00; E04B 1/34336; E04B 2001/34394; E04H 1/1216; E04H 2001/1283

USPC ... 52/34, 79.1, 79.5, 79.7, 79.8, 79.9, 79.12; 4/307, 476, 599, 663, 664

See application file for complete search history.

(56) References Cited

U.S. PATENT DOCUMENTS

| | | | |
|---|---|---|---|
| 2,188,213 | A | 1/1940 | Wilson |
| 2,538,736 | A | 1/1951 | Spencer |
| 2,611,134 | A | 9/1952 | Jarrett et al. |

(Continued)

FOREIGN PATENT DOCUMENTS

| | | | | |
|---|---|---|---|---|
| AU | WO 2007041757 A1 * | 4/2007 | ..... | E04B 1/3483 |
| CN | 101812862 A | 8/2010 | | |

(Continued)

OTHER PUBLICATIONS

Dutch Search Report, dated Oct. 23, 2012, from corresponding Dutch application.

(Continued)

*Primary Examiner* — Patrick Maestri
*Assistant Examiner* — Joseph J Sadlon
(74) *Attorney, Agent, or Firm* — Young & Thompson

(57) ABSTRACT

Transportable unit for forming a straight parallelepiped-shaped residential space, provided with a bottom and a covering, and upright walls extending in between them, which walls can be converted between a—particularly retracted-transport position and a—particularly extended-operational position, in which the unit has a larger height, wherein the unit is equipped as a sanitary unit having a series of toilet bowls, urinals and/or showers.

14 Claims, 13 Drawing Sheets

(51) Int. Cl.
*A47K 11/12* (2006.01)
*A47K 3/28* (2006.01)

(56) References Cited

U.S. PATENT DOCUMENTS

| | | | | |
|---|---|---|---|---|
| 2,817,846 | A | 12/1957 | Stift | |
| 2,827,004 | A | 3/1958 | Luce | |
| 2,862,253 | A | 12/1958 | Place | |
| 2,944,852 | A | 7/1960 | Snyder | |
| 3,005,205 | A * | 10/1961 | Breen | E03C 1/01 137/360 |
| 3,494,655 | A | 2/1970 | Linton | |
| 3,540,173 | A | 11/1970 | Johnides | |
| 3,668,710 | A | 6/1972 | Dowd | |
| 3,835,600 | A | 9/1974 | Padula et al. | |
| 4,064,570 | A | 12/1977 | Kim | |
| 4,107,795 | A | 8/1978 | Carter et al. | |
| 4,332,040 | A | 6/1982 | Palmer | |
| 4,454,613 | A | 6/1984 | Palmer | |
| 4,488,752 | A | 12/1984 | Broussard | |
| 4,653,125 | A | 3/1987 | Porter | |
| 5,379,466 | A | 1/1995 | Davies | |
| 5,778,462 | A | 7/1998 | Bjorklund et al. | |
| 5,832,676 | A | 11/1998 | Gillmore et al. | |
| 5,964,065 | A | 10/1999 | Migurski et al. | |
| 6,202,948 | B1 | 3/2001 | Kelly | |
| 6,712,414 | B2 | 3/2004 | Morrow | |
| 6,721,967 | B2 | 4/2004 | Braxton | |
| 6,948,196 | B2 | 9/2005 | Hinton | |
| 7,117,646 | B2 | 10/2006 | Blaisdell et al. | |
| 7,137,156 | B2 | 11/2006 | Yang | |
| 7,827,738 | B2 | 11/2010 | Abrams et al. | |
| 7,882,577 | B2 | 2/2011 | Merz et al. | |
| 8,256,443 | B2 | 9/2012 | Neal | |
| 8,291,647 | B2 | 10/2012 | Esposito | |
| 9,067,721 | B2 | 6/2015 | Mullaney | |
| 9,234,360 | B2 * | 1/2016 | Van Overbeek | E04B 1/343 |
| 9,260,189 | B2 * | 2/2016 | Savian | B64D 11/02 |
| 9,296,554 | B2 * | 3/2016 | Ferren | B65D 88/121 |
| 9,328,498 | B2 * | 5/2016 | Chen | E03D 11/00 |
| 9,334,105 | B2 * | 5/2016 | Dinter | B65D 88/121 |
| 9,340,963 | B2 * | 5/2016 | Ito | E03D 7/00 |
| 2002/0185889 | A1 | 12/2002 | Hernandez et al. | |
| 2002/0194796 | A1 | 12/2002 | Kress | |
| 2004/0040081 | A1 * | 3/2004 | Ostbo | A47K 11/02 4/449 |
| 2005/0284035 | A1 | 12/2005 | DeOvando et al. | |
| 2006/0201939 | A1 | 9/2006 | McPhee | |
| 2007/0079573 | A1 | 4/2007 | Sarine et al. | |
| 2008/0172953 | A1 | 7/2008 | Piorkowski | |
| 2008/0209624 | A1 | 9/2008 | Lavoie et al. | |
| 2008/0307714 | A1 | 12/2008 | Knoop | |
| 2011/0252719 | A1 | 10/2011 | Wallance | |
| 2012/0144576 | A1 | 6/2012 | Taylor et al. | |
| 2016/0160515 | A1 * | 6/2016 | Wallance | E04B 1/003 52/79.1 |

FOREIGN PATENT DOCUMENTS

| | | | |
|---|---|---|---|
| DE | 10021241 | | 9/2000 |
| DE | 20312312 | | 11/2003 |
| EP | 162397 | | 11/1985 |
| EP | 1630307 | A1 | 3/2006 |
| EP | 2546169 | A1 | 1/2013 |
| WO | 8707665 | | 12/1987 |
| WO | 2008089319 | | 7/2008 |
| WO | 2010018277 | | 2/2010 |
| WO | 2011110725 | | 9/2011 |
| WO | 2013095094 | | 6/2013 |
| ZA | 200509633 | | 10/2006 |

OTHER PUBLICATIONS

Chinese Office Action, dated Nov. 18, 2016, from corresponding Chinese Application No. CN 201380013531.8.

* cited by examiner

TRANSPORTABLE SANITARY UNIT

BACKGROUND OF THE INVENTION

Field of the Invention

The invention relates to a transportable residential space, particularly equipped as a sanitary unit.

Description of the Related Art

Residential spaces, including service spaces, that can be transported, set up and used as units, are generally known in various appearances, such as office unit, sanitary unit (toilet unit, shower unit), kitchen unit, sleeping unit, etcetera. The dimensions of said units vary strongly. Furthermore they have different ways to be handled, such as by using a hook, a tilting mechanism or corner fittings (known from ISO standard containers).

When transporting said residential units the entire contents thereof are transported along, not just the optional inventory, but mostly air. There are fully collapsible residential units, but inventory cannot be transported along with them.

The transportation costs have gone up considerably over the past few years. Transporting residential units therefore also becomes increasingly more expensive. As the demand for residential units, particularly for temporary use, still grows for instance for events, building sites, humanitarian aid, disasters, peace missions, war missions, post-war reconstruction etcetera, the need for transport in this field will continue to increase, however.

SUMMARY OF THE INVENTION

It is an object of the invention to provide a residential space designed as a sanitary unit that can be efficiently transported.

It is an object of the invention to provide a residential space designed as a sanitary unit that is suitable for efficient group transportation.

It is an object of the invention to provide a residential space designed as a sanitary unit that is advantageous as regards the required transportation energy.

It is an object of the invention to provide a residential space designed as a sanitary unit that is suitable for temporary deployment on a site of use and can advantageously be transported to and from it.

According to one aspect the invention provides a transportable unit for forming a straight parallelepiped-shaped residential space, provided with a bottom and a covering, and walls extending in between them, which walls can be converted between a —particularly retracted—transport position and a—particularly extended—operational position, in which the unit has a larger height, wherein the unit is equipped as a sanitary unit having a series of toilet bowls, urinals and/or showers. In that way one or more sanitary units can advantageously be transported to and from a site of use, such as an event site, and yet provide an at least substantially fully fledged sanitary facility at that location.

The bottom may offer room to a common drain pipe for the toilet bowls, urinals and/or showers. In a water-saving embodiment the drain pipe can be connected to a vacuum drainage system.

In one embodiment the walls can be converted telescopically.

The walls may comprise an upper wall attached to the covering and a lower wall attached to the bottom, wherein the upper wall and the lower wall preferably are of approximately similar height. In one embodiment the upper wall and the lower wall can be slid vertically into each other. In another embodiment the upper wall and the lower wall can be slid along each other in vertical direction, wherein the bottom preferably is part of a lower section of the unit and the covering is part of an upper section of the unit which can be moved in vertical direction with respect to each other.

The walls may form one or more sidewalls of the unit.

The walls may form partitions/inner walls for defining or shielding off sub-spaces for the toilet bowls and/or showers, which are accessible via an entrance for them, wherein preferably a sidewall of the unit is provided with doors for closing and opening the entry sides of the sub-spaces.

In one embodiment the sidewalls of the unit are part of a separation of a sub-space to the outside.

In one embodiment sub-spaces have been formed by niches or bays, that preferably from the outside of the unit are accessible optionally via individual doors. The sub-spaces or niches can be formed by niche sections, particularly by pairs of boxes, namely an upper box and a lower box, each having upright wall sections, preferably having three walls, namely on both sides of the sub-space and, as rear wall, opposite the entrance to the sub-space in question, which walls preferably are formed as one unity, such as of polyester, wherein both boxes are open on the entry side and on the upper and lower side, respectively, facing each other and wherein the upper box that is part of an upper section of the unit comprising the covering, and the lower box is part of a lower section of the unit comprising the bottom, wherein the upper section and the lower section can be vertically moved with respect to each other and wherein the upper box is oriented vertically reversed with respect to the lower box.

The lower box can furthermore comprise a bottom wall forming a surface for a user to stand on. The upper box can comprise an upper wall in which a light fixture is disposed.

Both boxes of a pair have such dimensions that, during conversion, their upright walls can be slid vertically along each other.

In one embodiment the boxes are detachably attached to the upper section, lower section of the unit. They can be replaced individually. The unit with boxes can thus form a modular system. The type of box set can optionally be selected, for instance selecting a combination of (lower) boxes having a toilet bowl and other (lower) boxes having a urinal, each time combined with the same upper boxes.

In one embodiment an inner wall forms a partition wall between two series of urinals and/or toilet bowls, the individual branch lines of which (bowls or urinals) to the drain pipe are at least partially incorporated in the partition wall. The partition wall may have a lower partition wall and an upper partition wall, wherein the lower partition wall is divided into a first part and a second part that each support the toilet bowls or urinals of a respective series, and between them define an accommodation space for the upper partition wall. The upper partition wall can be entirely free of fluid pipes, each lower partition wall part provides support to the bowls or urinals, respectively, of both series and offers room to the corresponding individual branch line for each bowl or urinal and together with the other lower partition wall part offers room to the upper partition wall in the transport position.

The toilet bowls, urinals and/or shower heads preferably are arranged in the section of the unit comprising the bottom, so that the pipe system can remain in its place during the conversion activities.

The sanitary residential unit in the transport position preferably has half a standard height of a standard freight container. Because in the lowered, particularly retracted position, the sanitary residential unit has half a standard height, two of such sanitary units, in lowered, particularly retracted position, placed on top of one another, will as regards height correspond with an uncollapsible standard container (ISO) of standard height. In that way within a same transport volume two—retracted —sanitary residential units can be moved. Two retracted sanitary residential units take up as much room as one regular standard container. Due to half the height of the sanitary residential spaces during transportation the sanitary inventory can furthermore at least substantially remain in the residential space and there is room for transporting other goods that are required at the destination, such as gangways, barriers.

In the operational position the sanitary residential unit can have a full standard height of a standard container, so that in a multiple transport with an odd number of units a standard height can always be provided if one unit is not retracted.

The standard height will particularly be the height of a 20 ft. TEU container, a 40 ft. TEU container or a 45 ft. High Cube container that are used a lot nowadays. They are 8.6 ft, 8.6 ft and 9.6 ft respectively. These are standard containers under the ISO standard.

Adaptation to standard transportation facilities for freight containers is increased if the length and width of the sanitary unit equal the length and width, respectively, of a 20 ft. TEU container, a 40 ft. TEU container or a 45 ft. High Cube container, that means 20'×8', 40'×8' and 45'×8', respectively.

If the length and width of the sanitary unit equal the length and width, respectively, of a 20 ft. TEU container and the height in the transport position equals half a height of a 45 ft. High Cube container, an advantageous adaptation to transportation means, particularly trucks, is obtained that are often adapted to the 20 ft. of the TEU, and in the operational position a larger overlap can be realised between parts of the unit that slide into/along each other during the conversion.

The handling of the unit according to the invention is further improved if it is provided with ISO corner fittings on the corners, preferably all corners.

In one embodiment a sidewall comprises an upper door part and a lower door part, respectively, for forming an entrance door to the residential space in the operational position, wherein the upper door part and the lower door part can hinge about a vertical hinge centre line and are attached to the covering and bottom, or the upper section and the lower section, by an upper hinge and a lower hinge, respectively, particularly to a frame section for them, particularly a horizontal frame section, wherein the hinge centre lines of the upper hinge and the lower hinge are in line with each other. This increases the freedom of design for the sidewall in question, as no hinges need to be attached to them that are in line with the hinge centre lines. The upper door part and the lower door part can be provided with connecting parts for mutual connection in the operational position, so that a door is obtained that can be operated as one unity. In one embodiment the upper door part and the lower door part can be vertically slid into each other. In another embodiment the upper door part and the lower door part can be slid along each other in vertical direction.

In one embodiment with doors, the doors are detachable and in the transport position of the unit they can be stored in the unit, for after conversion of the unit into the operational position being hung at the wanted locations.

It is an object of the invention to provide a residential space designed as a unit that can efficiently be transported.

It is an object of the invention to provide a residential space designed as a unit that is suitable for efficient group transportation.

It is an object of the invention to provide a residential space designed as a unit that is advantageous as regards the required transportation energy.

According to a further aspect the invention provides a transportable (residential) unit for forming a straight parallelepiped-shaped residential space, provided with a bottom and a covering, and one or more sidewalls extending in between them, which sidewalls can be converted, particularly telescopically extendable/retractable, between a —particularly retracted—transport position, in which the residential unit has half a standard height of a standard freight container, and a —particularly extended—operational position, in which the unit has a larger height. Because in the lowered, particularly retracted position, the residential unit has half a standard height, two of such units, in lowered, particularly retracted position, placed on top of one another, will as regards height correspond with a fixed standard container (ISO) of standard height. In that way within a same transport volume two—retracted—residential units can be moved. Two retracted residential units take up as much room as one regular standard container.

Due to half the height of the residential spaces during transportation the inventory can furthermore at least substantially remain in the residential space and there is room for transporting other goods that are required at the destination, such as gangways, barriers. Furniture and/or pipes can at least substantially be fully housed in the section of the unit comprising the bottom.

In the operational position the unit preferably has a full standard height of a standard freight container, so that in multiple transport with an odd number of units a standard height can always be provided if one unit is not retracted.

The standard height can be the height of a 20 ft. TEU container, a 40 ft. TEU container or a 45 ft. High Cube container.

The length and width of the unit can equal the length and width, respectively, of a 20 ft. TEU container, a 40 ft. TEU container or a 45 ft. High Cube container.

The length and width of the unit can equal the length and width, respectively, of a 20 ft. TEU container and the height in the transport position equals half a height of a 45 ft. High Cube container.

The sidewalls can be converted telescopically.

In one embodiment one or more sidewalls comprise an upper sidewall attached to the covering and a lower sidewall attached to the bottom, wherein the upper sidewall and the lower sidewall preferably are of approximately similar height. The upper sidewall and the lower sidewall can be slid vertically into each other or be slid along vertically adjacent to each other.

The upper sidewall and the lower sidewall of at least one sidewall comprise an upper door part and a lower door part, respectively, for forming an entrance door to the residential space in the operational position, wherein the upper door part and the lower door part can hinge about a vertical hinge centre line and are attached to the covering and the bottom by an upper hinge and a lower hinge, respectively, particularly to a frame section for them, particularly a horizontal frame section, wherein the hinge centre lines of the upper hinge and the lower hinge are in line with each other. The upper door part and the lower door part can be provided with connecting parts for mutual connection in the operational position.

The unit may be provided with partitions/inner walls for shielding off sub-spaces for the toilet bowls and/or showers. The sub-spaces can be closed off by respective doors.

In one embodiment the inner walls comprise an upper inner wall attached to the covering and a lower inner wall attached to the bottom, that preferably can be telescopically slid into/out and/or along each other in vertical direction.

An inner wall can form a partition wall between two series of urinals and/or toilet bowls, the individual branch lines of which to the drain pipe are at least partially incorporated in the partition wall. The partition wall may have a lower partition wall and an upper partition wall, wherein the lower partition wall is divided into a first part and a second part that each support a toilet bowl or urinal of a respective series, and between them define an accommodation space for the upper partition wall.

According to a further aspect the invention provides a transportable unit for forming a straight parallelepiped-shaped residential space, provided with a bottom and a covering, and one or more, particularly upright walls extending in between them, which unit can be converted between a —particularly retracted, relatively low—transport position and a —particularly in vertical direction extended, relatively high—operational position, wherein the bottom and the covering are spaced part more widely than in the transport position, wherein at least one of said wall comprises a door for giving access to at least a part of the residential space in the operational position, which door comprises an upper door part attached to the covering and a lower door part attached to the bottom, wherein the upper door part and the lower door part can hinge about a vertical hinge centre line and are attached to the covering and the bottom by means of an upper hinge and a lower hinge, respectively, wherein the hinge centre lines of the upper hinge and the lower hinge are in line with each other. The upper door part and the lower door part can in that case be provided with connecting parts for mutual connection in the operational position, so that they form one assembled door. In one embodiment the upper door part and the lower door part can be vertically slid into each other. In another embodiment the upper door part and the lower door part can be slid along each other in vertical direction.

In order to prevent that during manipulation during transportation the unit changes from the transport position into the operational position the unit can be provided with means for locking the unit in the transport position.

The unit can be equipped in various ways, depending on the intended use, such as a sleeping unit, sanitary (short stay) unit, kitchen.

In one embodiment, especially for events, the unit is equipped as a sanitary unit having a series of toilet bowls, urinals and/or showers.

In one embodiment having one or more doors that may or may not be in accordance with the assembled doors discussed above, a door may for instance provide access to one single sub-space having one toilet bowl or urinal.

The toilet bowls, urinals and/or shower heads may be arranged in the section of the unit comprising the bottom.

In the bottom may be accommodated a common drain pipe for the toilet bowls, urinals and/or showers. The drain pipe can be suitable for connection to a vacuum drainage system.

The transportable unit according to the invention can be provided with an operable conversion device for converting the walls between the transport position and the operational position and vice versa. The conversion device can be provided with a manual operation.

Extending the unit can be effected in various ways; manually, pneumatically, locomotory or hydraulically. The conversion device may comprise manually driven cables, chains and the like, and optionally a pulley system for them.

The conversion device may comprise hydraulic or pneumatic cylinders. The cylinders can be housed in the covering or the bottom of the unit. In a compact embodiment the cylinders are housed in the covering or the bottom of the unit. Particularly the bottom is suitable for this purpose. The cylinders may for instance drive cables that run through the bottom or covering to the corner columns and transfer lifting forces in the columns for extending the unit. In one embodiment the unit can be converted from the transport position into the operational position by means of a fork-lift truck, of which the fork engages the upper section, particularly the covering.

According to a further aspect the invention provides an assembly of two units according to the invention, stacked onto one another.

According to a further aspect the invention provides an assembly of a number of transportable units according to the invention, wherein one unit has a length L corresponding with the standard length of a standard freight container and n units have a length L' corresponding with $1/n \times L$, wherein n is an integer. In an embodiment that is advantageous to transportation by truck, L is 20 ft. of a 20' TEU container. The invention also provides a truck or trailer onto which an assembly according to the invention has been placed.

The aspects and measures described in this description and the claims of the application and/or shown in the drawings of this application may where possible also be used individually. Said individual aspects may be the subject of divisional patent applications relating thereto. This particularly applies to the measures and aspects that are described per se in the sub claims.

BRIEF DESCRIPTION OF THE DRAWINGS

The invention will be elucidated on the basis of a number of exemplary embodiments shown in the attached drawings, in which.

DETAILED DESCRIPTION OF THE INVENTION

Figure 1A:
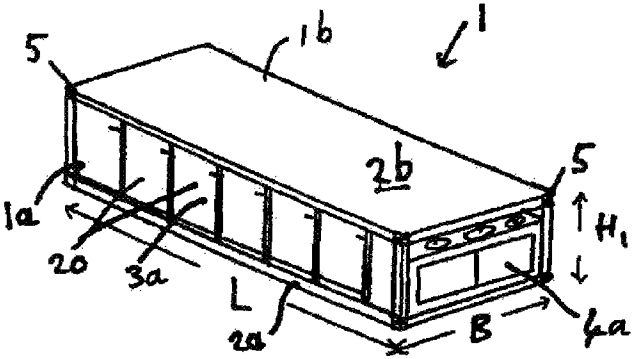
FIGS. 1A and 1B show an isometric view of a first exemplary embodiment of a sanitary unit according to the invention, in the transport position and the operational position, respectively.
Figure 1B:
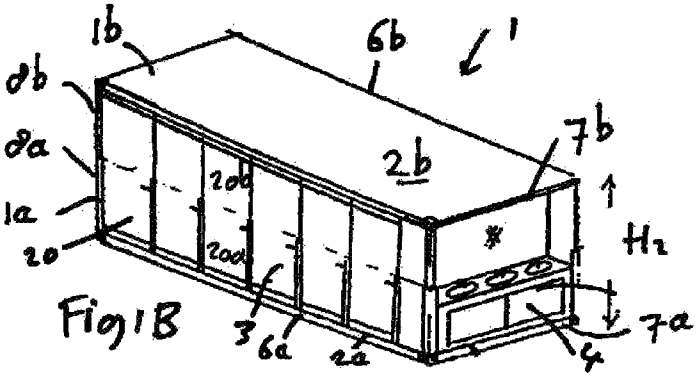

The container-shaped sanitary unit 1 of FIGS. 1A and 1B comprises a lower section 1*a* and an upper section 1*b*. The lower section 1*a* comprises a bottom 2*a*, upright longitudinal side walls 3*a*, upright end sidewalls 4*a* and in a usual manner longitudinal girders 6*a*, cross girders 7*a* and columns 8*a*. The upper section 1*b* comprises a covering 2*b*, longitudinal side walls 3*b*, end sidewalls 4*b* and in a usual manner longitudinal girders 6*b*, cross girders 7*b* and columns 8*b*, also see FIGS. 2A,B. The girders 6*a,b* and 7*a,b* and columns 8*a,b* meet each other in the corners, where standard (ISO) corner fittings 5 are situated. The columns 8*a,b* are locked with respect to each other, such that they are capable of absorbing vertical weight forces and also in case of lifting forces exerted on the corner fittings 5 on the covering 2*b* they do not move relative to each other in order to facilitate loading onto a truck, train, ship, etc.

In FIG. 1A the container-shaped unit 1 is shown in the retracted transport position in which it has a length L of 20 ft., a width B of 8 ft. and a height H1 of 4 ft. and 9 inches. As a result the unit 1 has the length and width of a 20' TEU container indeed, but half the standard height of 0.5 Hs of a—in this case different—standard container, in this case a High Cube container (9 ft., 6 inches).

Figures 2A, 2B, 2C, 2D:
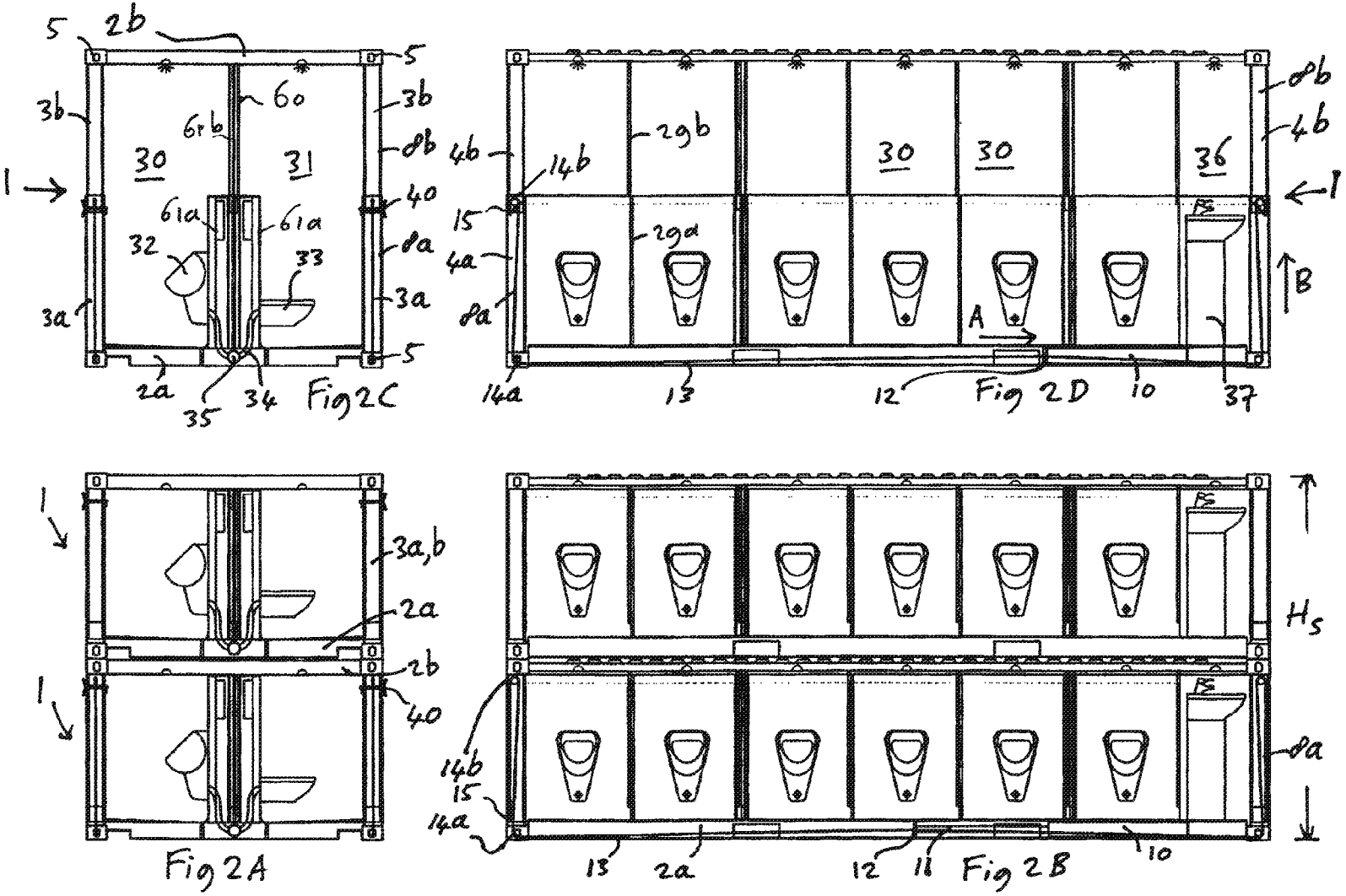
FIGS. 2A,B and 2C,D show a vertical cross-section and a vertical longitudinal section, respectively, of two units of FIG. 1A stacked onto each other and a vertical cross-section and vertical longitudinal section, respectively, of one unit of FIGS. 2A,B in the operational position of FIG. 1B.

When for transportation two container-like units 1 in the condition of FIG. 1A are stacked onto one another, then the joint height, also see FIGS. 2A and 2B, equals the standard height Hs of a High Cube container, namely 9 ft. and 6 inches. The 20 ft. length is advantageous for transportation by a truck adapted to TEU container transport, with or without ditto trailer, also see FIG. 7.

In FIG. 1B the unit 1 has been converted from the transport position into the operational position, in which the height is H2 that may equal 2×H1 (=Hs). The upper section 1*b* is extended upwards and in that position the columns 8*a,b* are locked with respect to each other, wherein the longitudinal girders 6*a,b*, cross girders 7*a,b* and columns 8*a,b* form a frame. The longitudinal sidewalls 3*a,b* and the end sidewalls 4*a,b* now form longitudinal sidewalls 3 and end sidewalls 4. They can be designed in various ways, a longitudinal sidewall 3 with doors 20 (also see FIGS. 6A,B) and an end sidewall 4 with washbasins 37 is shown. A mirror wall behind the washbasins slides down behind the washbasins 37 when telescopically retracting the unit.

This can be seen in FIGS. 2A,B. The mutual locking of the columns 8*a,b* takes place by means of a locking pin 40, that can be inserted and secured in a suitable hole of a vertical series of holes in the columns 8*a,b*, both in the transport position of FIGS. 2A,B and in the operational position of FIGS. 2C,D. By choosing H1 to be half the standard height (0.5 Hs) of a High Cube container (L=45 ft., B=8 ft., H=9 ft. 6 inches) instead of half the standard height (0.5×8 ft., 6 inches) of a 20' TEU container, the overlap of the columns 8*a* and 8*b* in the operational position may have a larger length. The larger overlap may be advantageous to the design of the connection (as well as its stability) between both columns 8*a,b* in the operational position.

In the stacked position of FIGS. 2A,B all outer dimensions of the units 1, also the appendages, remain within the standard dimensions in question, in this case that means the 20 ft. length, the 8 ft. width and the 9 ft. 6 inches height.

For extending the unit 1 into the operational position, a central cylinder 10 has been disposed in the bottom 2*a*, within the profile of the bottom 2*a*, wherein at the end of the piston rod 11 an attachment plate 12 is arranged. Onto the plate 12 cables 13 (also see FIGS. 2E and 2F) are attached that circulate around pulleys 14*c,d* in the bottom 2*a* to the four corners, where they are guided around pulleys 14*a* into a vertical direction, to pulleys 14*b* in the upper end of columns 8*a*, see FIGS. 2B and 2D. The outer ends of the cables 13 are attached to the lower end of the columns 8*b*. Thus nearly the entire conversion device is accommodated in lower section 1*a*.

Figure 2E:
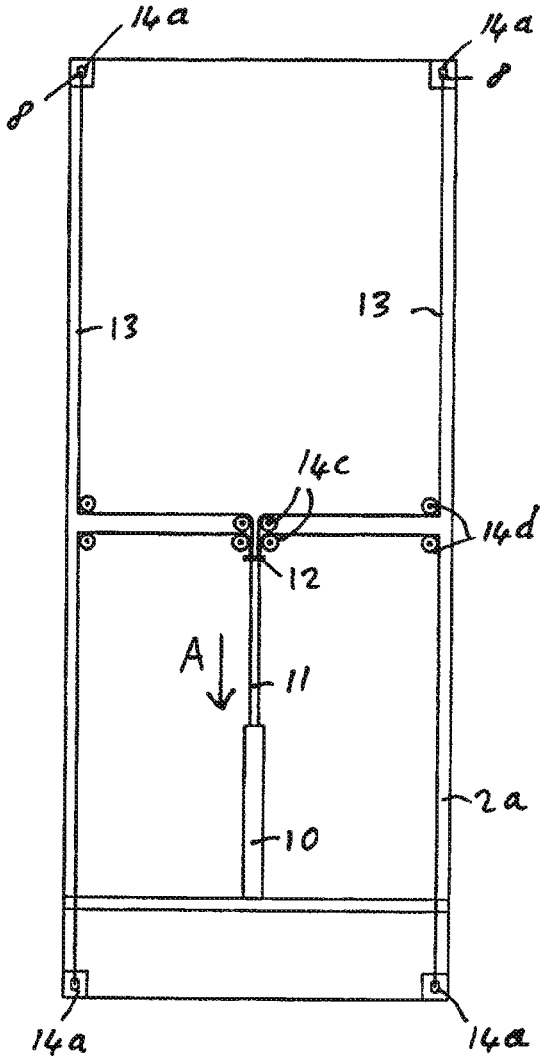
FIGS. 2E and 2F show schematic depictions of a cylinder accommodated in the bottom of the sanitary unit of FIGS. 2A-D, in the transport position and the operational position, respectively.
Figure 2F:
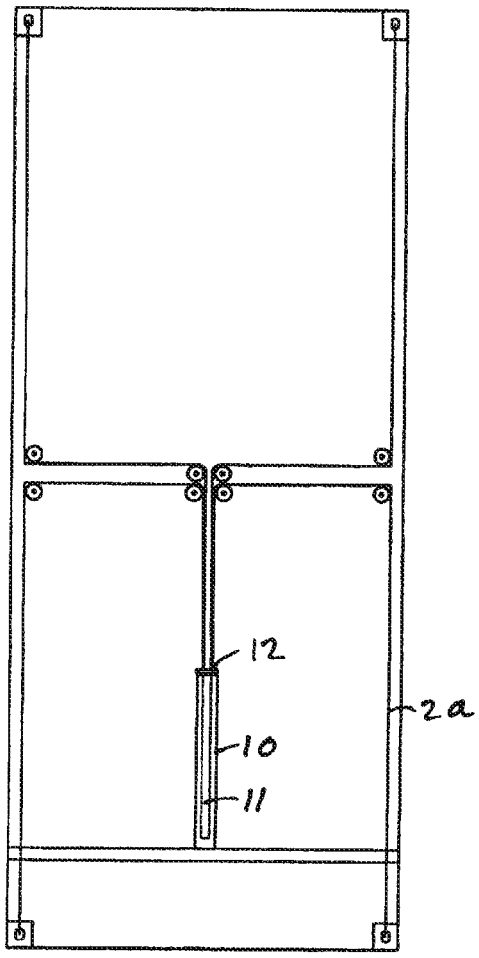

When retracting the piston rod, from the position of FIG. 2E to the one of FIG. 2F, the cables 13 are pulled in and their outer ends pulled up, while taking along the lower end of the columns 8*b* upwards, until the position of FIG. 2C,D is achieved. In extended position the extended part of the unit with columns 8*b* still largely remains in the unextended columns 8*a* in order to form a stable unity. The locking takes place in the part where the columns overlap each other.

The locking of the extended position therefore takes place both in the fully retracted position and the fully extended position. In the retracted position said locking offers the telescopically retracted unit an undetachable character and provides a high degree of rigidity of the unity in order to comply with the demands transportation of the unit makes. In the extended position the locking provides safety and relieves the hoisting cables and the cylinders. Locking can be carried out automatically, mechanically, pneumatically, hydraulically or manually.

The sidewalls 3*a,b*, 4*a,b* and columns 8*a,b* can slide into/out of or along each other depending on the manner of construction and specifications of the extended unit and the technical demands made to it. The extension system can also be incorporated in one or several columns that can be located elsewhere in the unit than the corner columns. If the functionality of the unit does not permit placing the hoisting system in the bottom it can also be incorporated elsewhere in order to provide the same functionality.

In FIGS. 2A-D the inner space of the unit is divided by longitudinal partition wall 60 into two series of sub-spaces, namely sub-spaces 30 for urinals 32 and sub-spaces 31 for toilet bowls 33, wherein the adjacent sub-spaces are separated from each other by inner walls 29*a,b* wherein inner wall part 29*a* is part of the lower section 1*a* and inner wall part 29*b* is part of the upper section 1*b*. The wall parts 29*a*, 29*b* can slide along each other when retracting/extending the unit 1. On the longitudinal sides both series of sub-spaces are accessible via individual doors 20 (FIGS. 1A,B and 6A,B). All the pipework for slops and for drainage (34, 35)

is housed in the lower section 1*a*. In case of urinals, doors and making sub-spaces can be dispensed with, instead thereof partitions can be mounted to the centre wall, which if necessary can also be divided into a part attached to the upper section and a part attached to the lower section of the unit, for during conversion being telescopically extended to have the desired height in the operational position.

The device can also be designed differently. For instance in FIGS. 3A-D an example is given of a combination of sub-spaces 30 for urinals 32 and sub-spaces 31 for toiles bowls 33 in combination with sub-spaces for showers 39. In FIGS. 4A-D a set-up is shown having only sub-spaces 38 for showers 39. In FIGS. 5A-D a set-up is shown having only sub-spaces 31 for toilet bowls 33.

Figure 3D:
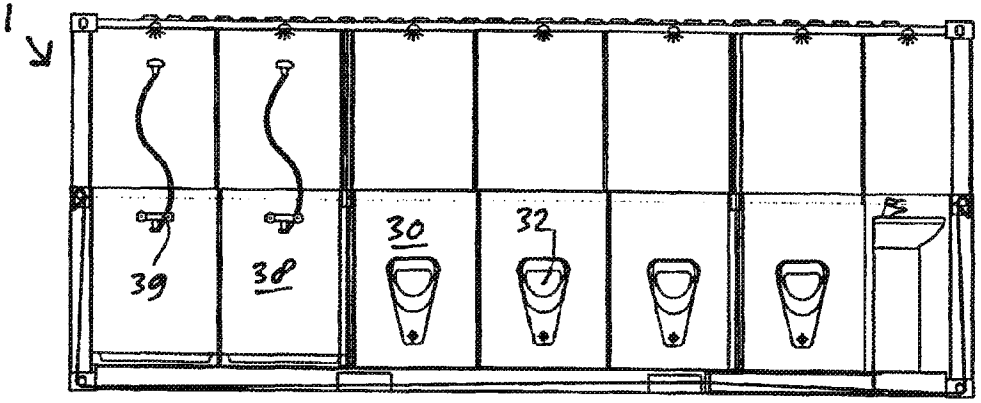
FIGS. 3A,B and 3C,D show a vertical cross-section and a vertical longitudinal section, respectively, of two other sanitary units according to the invention stacked onto each other, in the transport position, and a vertical cross-section and a vertical longitudinal section, respectively, of one unit of FIGS. 3A,B in the operational position.
Figure 3B:
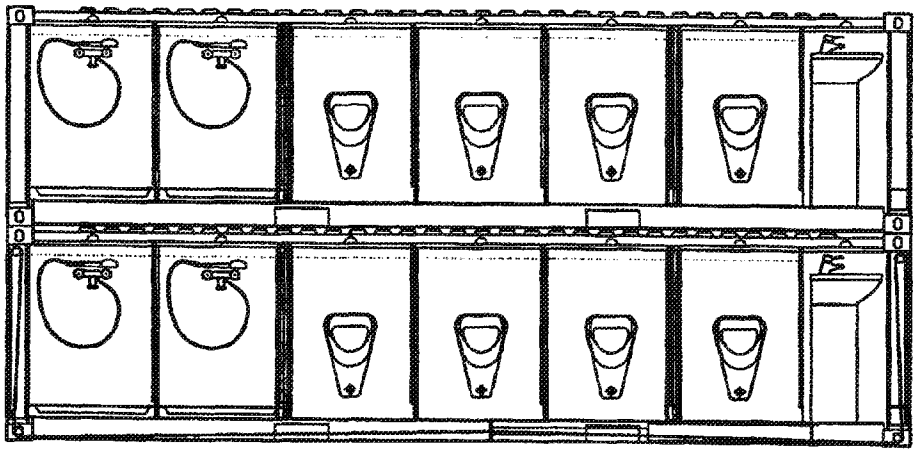
Figure 3C:
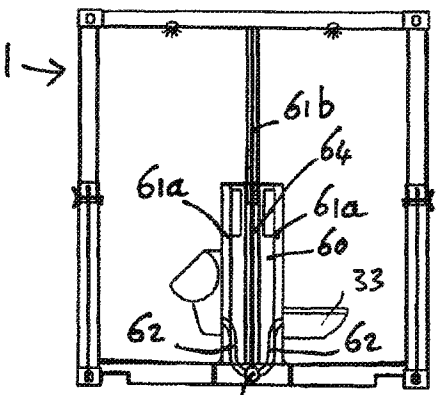
Figure 3A:
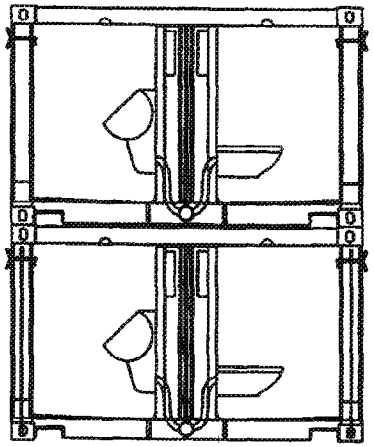
Figure 4D:
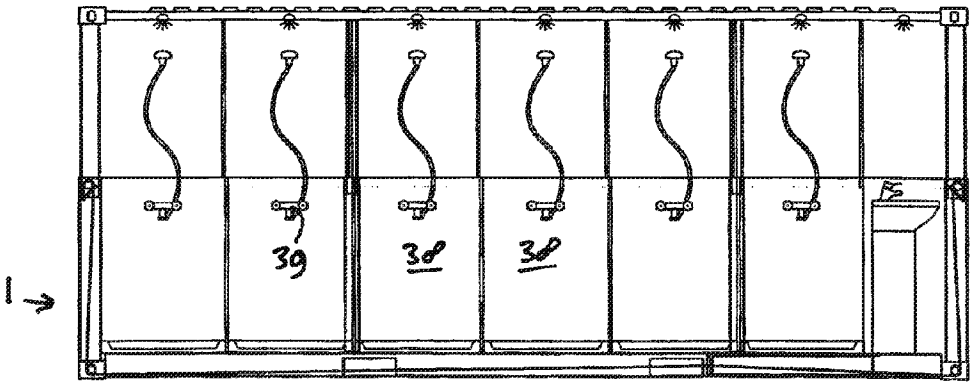
FIGS. 4A,B and 4C,D show a vertical cross-section and a vertical longitudinal section, respectively, of yet two other sanitary units according to the invention stacked onto each other, in the transport position, and a vertical cross-section and a vertical longitudinal section, respectively, of one unit of FIGS. 4A,B in the operational position.
Figure 4B:
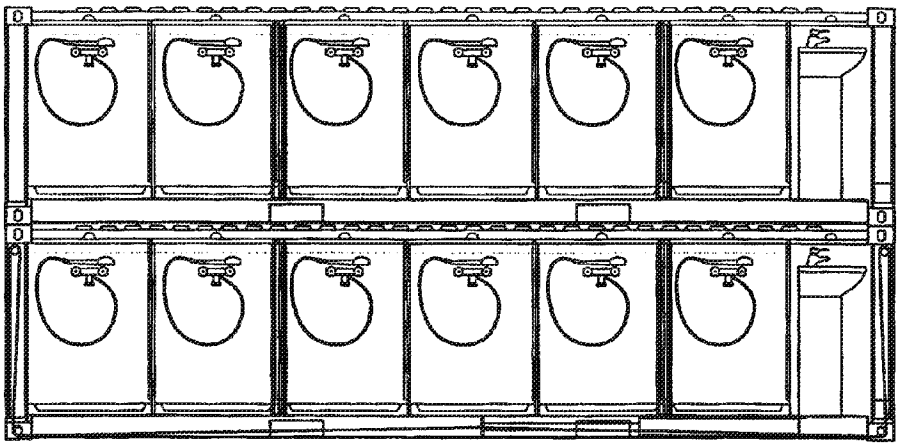
Figure 4C:
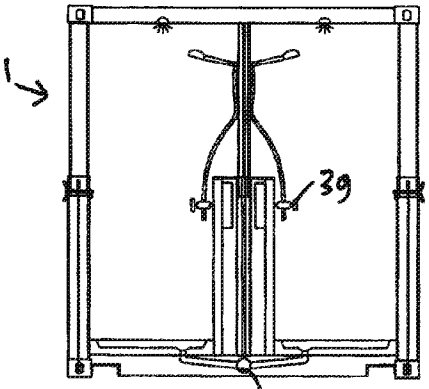
Figure 4A:
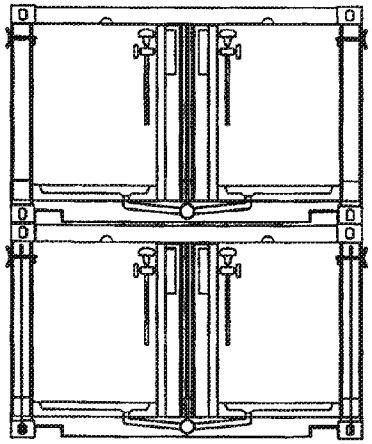
Figure 5D:
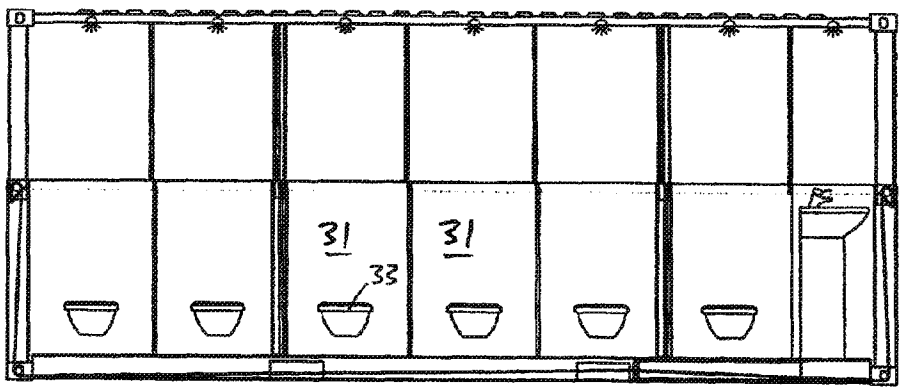
FIGS. 5A,B and 5C,D show a vertical cross-section and a vertical longitudinal section, respectively, of yet two other sanitary units according to the invention stacked onto each other, in the transport position, and a vertical cross-section and a vertical longitudinal section, respectively, of one unit of FIGS. 5A,B in the operational position.
Figure 5B:
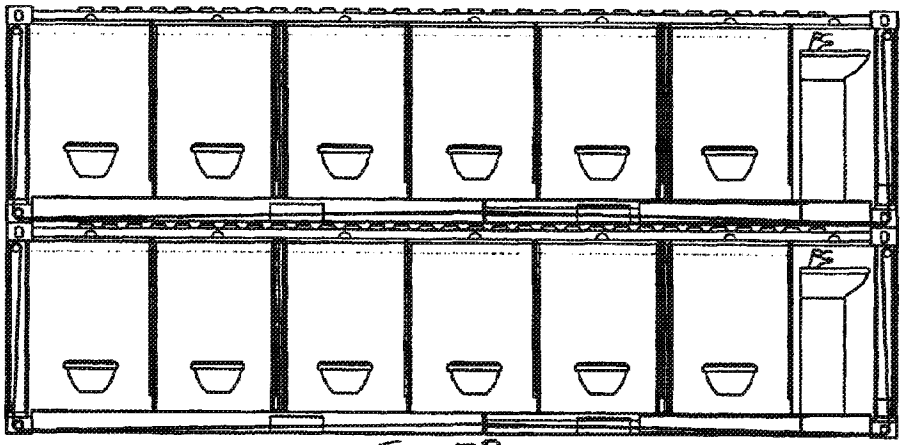
Figure 5C:
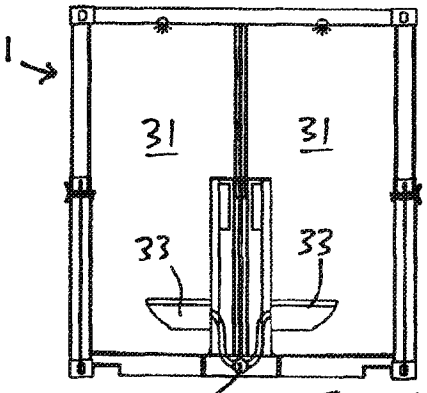
Figure 5A:
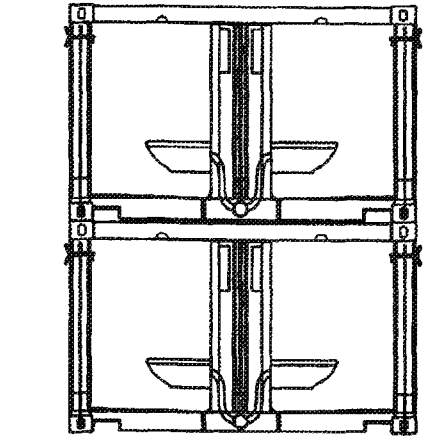

FIGS. 2C and 3C illustrate that the partition wall 60, forming a main separation between two series of toilet bowls and/or urinals, is divided into a two-part lower partition wall 61*a* and an upper partition wall 61*b*. For each toilet bowl or urinal, each lower partition wall part 61*a* houses a drain/branch 62 for discharging water/urine/faeces to a central drain pipe 63 arranged in the bottom which drain pipe can be connected to a vacuum system. Both lower partition wall parts 61*a* define an accommodation space 64 for the upper partition wall 61*b* in the transport position of the unit 1.

In the example of FIGS. 1A,B the doors 20 are built up from a lower door part 20*a*, that is part of the lower section 1*a*, and an upper door part 20*b* that is part of the upper section 1*b*. The lower door part 20*a* is provided with a lock with handle 21. Particular is that each of the door parts 20*a,b* is not attached to a post by a hinge but to the bottom 2*a* and the covering 2*b*, by hinges 22*a,b*. Their hinge centre lines S1 and S2 are in line with each other, so that the extended door 20 is able to hinge and function as one unity. The (entrance) doors 20 can be equipped with individual locks with which the door can be locked both in the extended position and in the retracted position. Hinge positions along the vertical edges of the door parts 20*a,b* do not have to be taken into consideration. By means of locking pins 23 both door parts 20*a,b* are connected to each other so that they are swung together during use. Suitable hinges for that purpose are known from shower walls and walls of refrigeration spaces, for instance see the hinges from the Prisma series by CR Laurence of Europe GmbH. The door parts 20*a,b* can slide both into or along each other. Optionally the doors can also be designed so as to fold up.

Figure 9G:
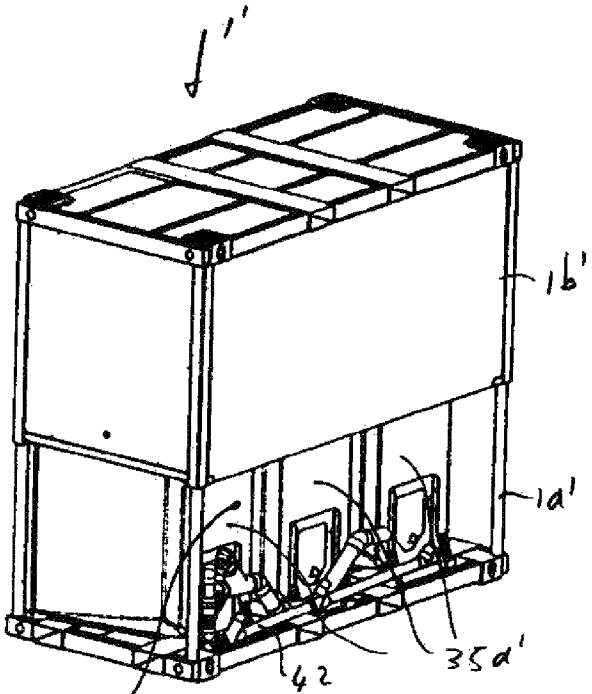
FIGS. 9A-I show two views of a smaller unit according to FIGS. 8A,B in the transport position, intermediate position and operational position and of a part thereof in those three positions.
Figure 9D:
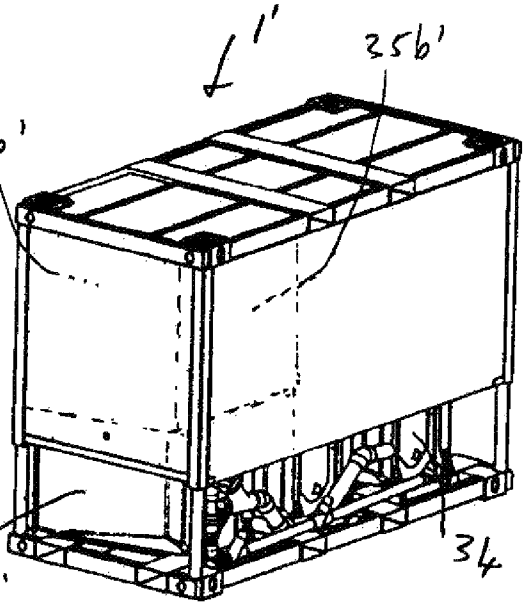
Figure 9A:
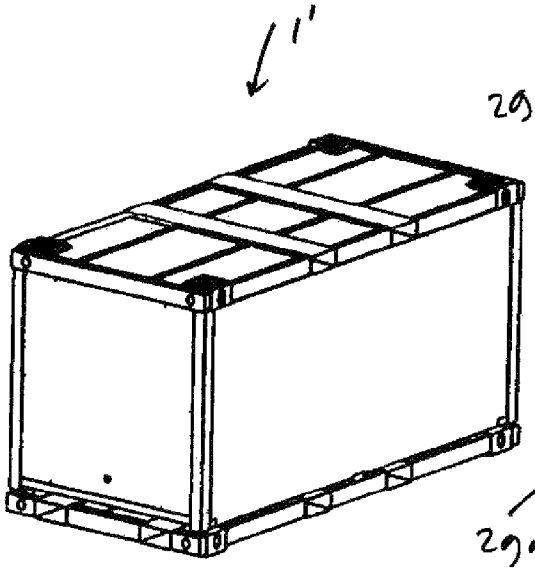
Figures 9B, 9E, 9H:
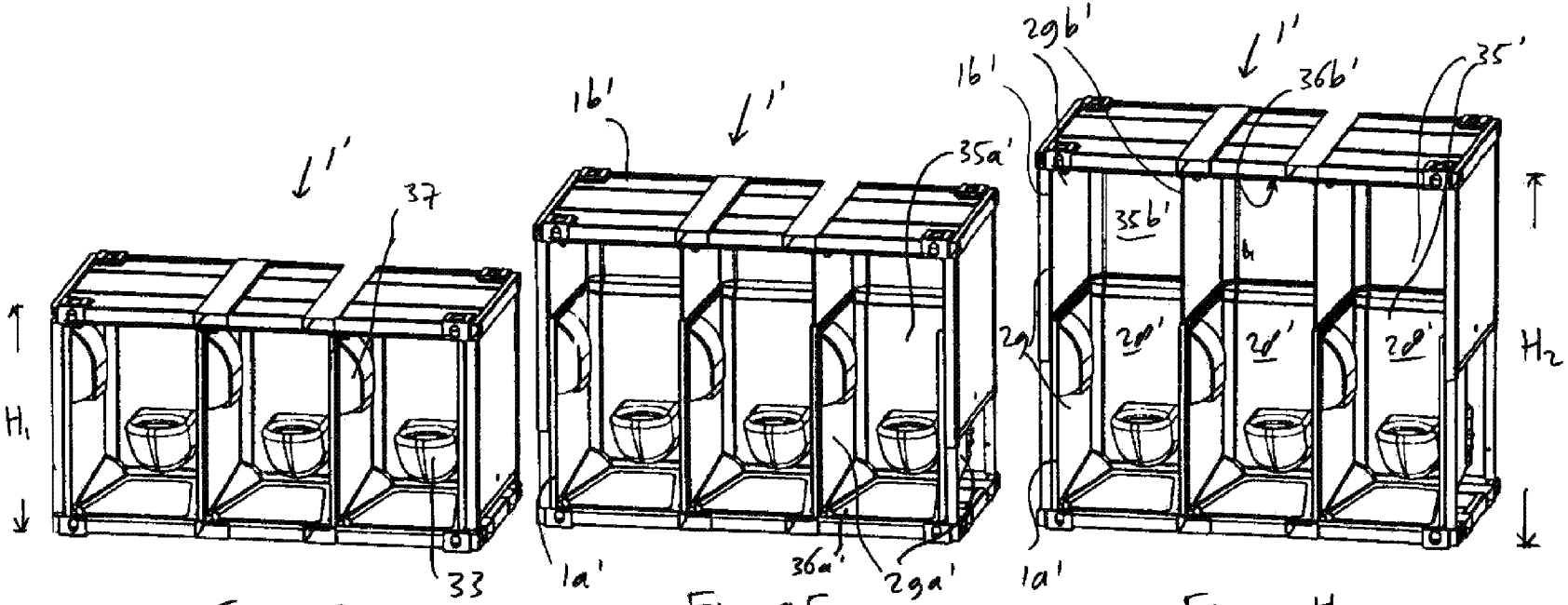

FIGS. 9A-I elucidate a small unit 1', of which the transport position is shown in FIGS. 9A,B, the operational position in FIGS. 9G,H and an intermediate position in FIGS. 9D,E. The unit 1' comprises three bay-shaped or niche-shaped sub-spaces 28' that have each been provided with a toilet bowl and with a paper dispenser 35.

Figure 6A:
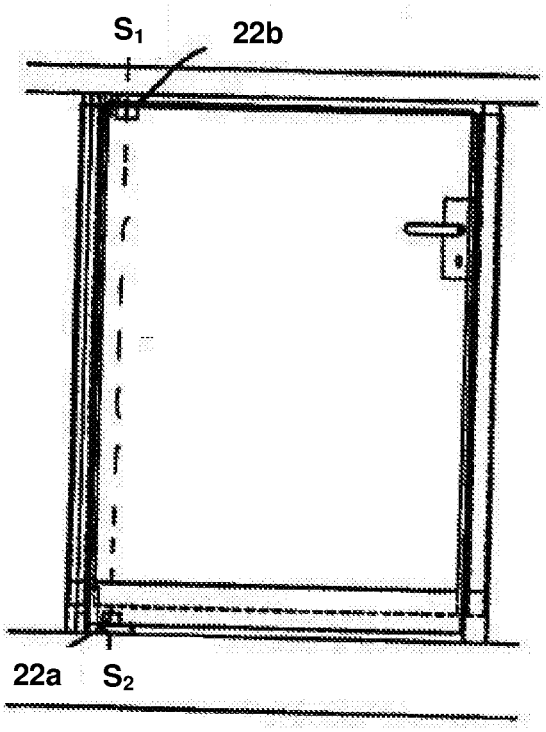
FIGS. 6A and 6B show views of a two-part door for a unit according to the invention, in the transport position and the operational position, respectively.
Figure 6B:
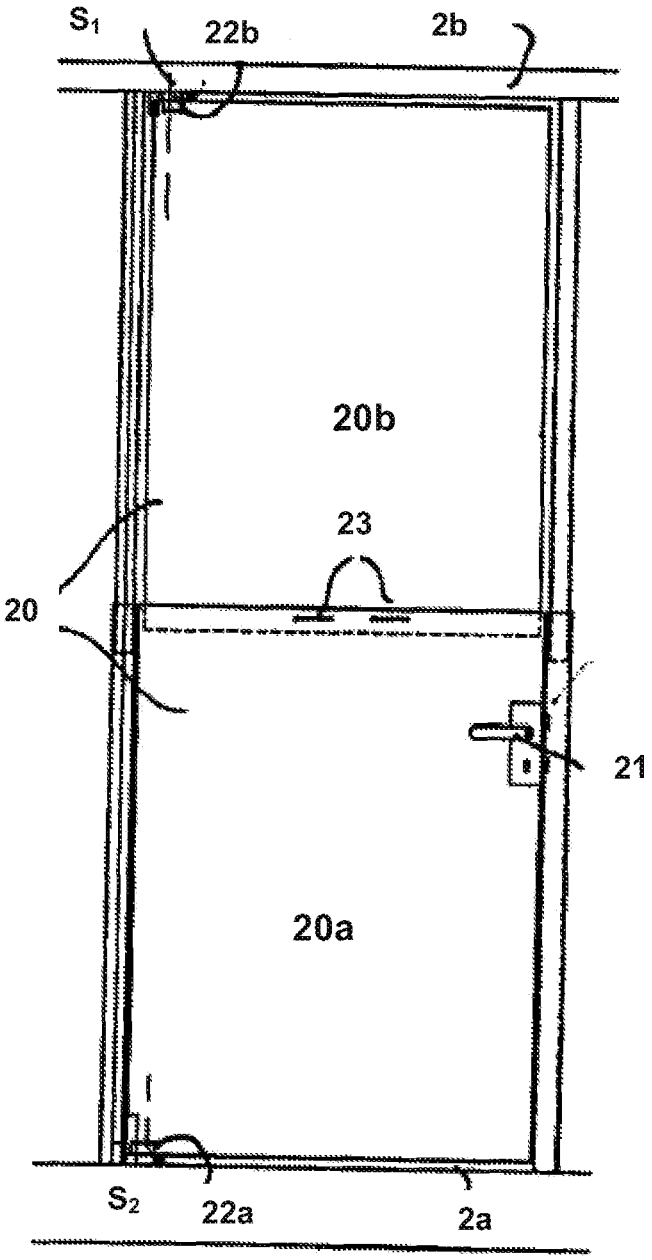

On the entry side each sub space can be shielded/closed off by means of a door that is not shown here, which doors can be assembled, for instance according to FIGS. 6A,B. In the transport position of the unit the doors or door parts can, if necessary, be stored in the space 34 formed on the rear side of the sub-spaces.

The sub-spaces 28' are positioned adjacent to each other, with the entrance on the same side. The niche-shaped sub-spaces 28' are formed by two boxes that can be slid into and out of each other, namely lower box 28*a*' and upper box 28*b*'. The lower box 28*a*' each time comprises three upright wall sections, namely two wall sections 29*a*' and 29*a*' on the sides and a rear wall section 35*a*' situated in between them. The upper box 28*b*' each time comprises three upright wall sections namely two wall sections 29*b*, and 29*b*' on the sides and a rear wall section 35*b*' in between them. The upright wall sections 29*a*',b' thus each time form a common wall 29' and the wall sections 35*a*',b' each time a common wall 35'. Said wall sections can each time be formed as one unity with each other such as from polyester.

The lower box 28*a*' is provided with a bottom 36*a*' and the upper box is provided with a covering 36*b*'. They can be formed as one unity in the box 28*a*', 28*b*' as well.

The boxes 28*a*' and 28*b*' thus are open towards the entrance, as well as in vertical direction facing each other. The upper box therefore is inverted with respect to the lower box.

The lower boxes 28*a*' and the upper boxes 28*b*' preferably are detachably attached to the frame, such as transverse beams, of the lower section 1*a*' and the upper section 1*b*', respectively. This can be done by means of bolts, or for the upper box, by means of a suspension, for which purpose holes 39' (FIG. 91) can be provided, into which hooks attached to the upper section can engage.

The boxes 28*a*', 28*b*' can be replaced individually, without hampering or having to engage the adjacent boxes.

The lower box 28*a*' supports the toilet bowl 33 and the dispenser 37. The upper box 28*b*' can be provided with a light, see 41' in FIG. 9C.

The space 34 cannot only provide room to doors, but also to a combined drain pipe system 42, that is connected to the drains 40 and can be connected to a further drainage, particularly working on vacuum.

Figures 9C, 9F, 9I:
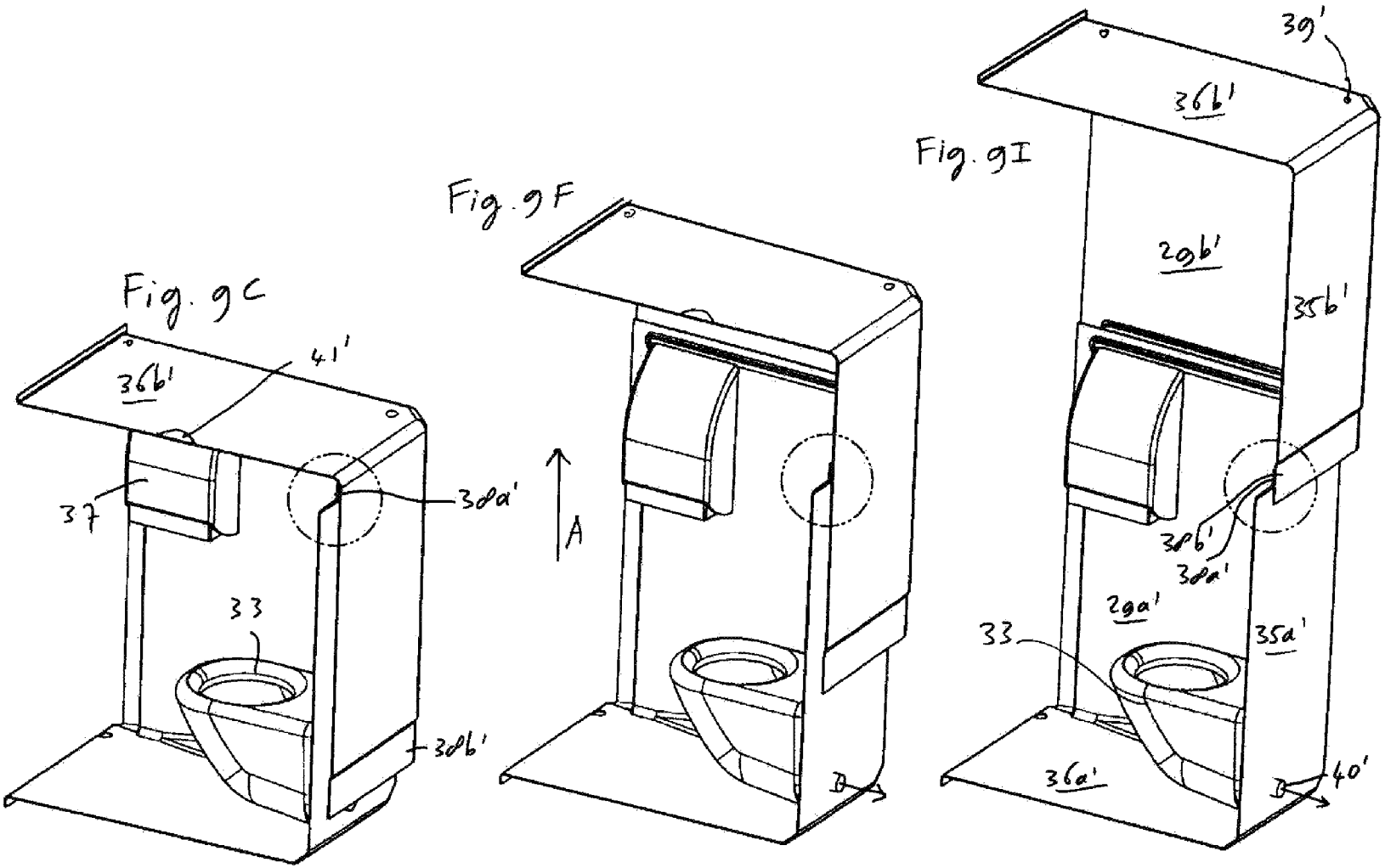

When converting the unit from the transport position of FIGS. 9A,B to the operational position of FIGS. 9G,H the upright box walls are able to slide closely along each other (direction A, FIG. 9F). For closing off to a certain extent, the upper edge of the wall sections 29*a*', 35*a*' is provided with a flange edge 38*a*' that is offset to the outside, which flange edge in the operational position of FIG. 91 at least almost abuts the upper edge 38*b*' that is offset to the inside. As can be seen the walls 29*a*', 35*a*' just fit within the walls 29*b*', 35*b'*.

The boxes 28*a*', 28*b*' are easy to clean.

A comparable set-up having such niche-shaped spaces 28' is also possible in larger units, such as unit 1, discussed above.

Figure 7:
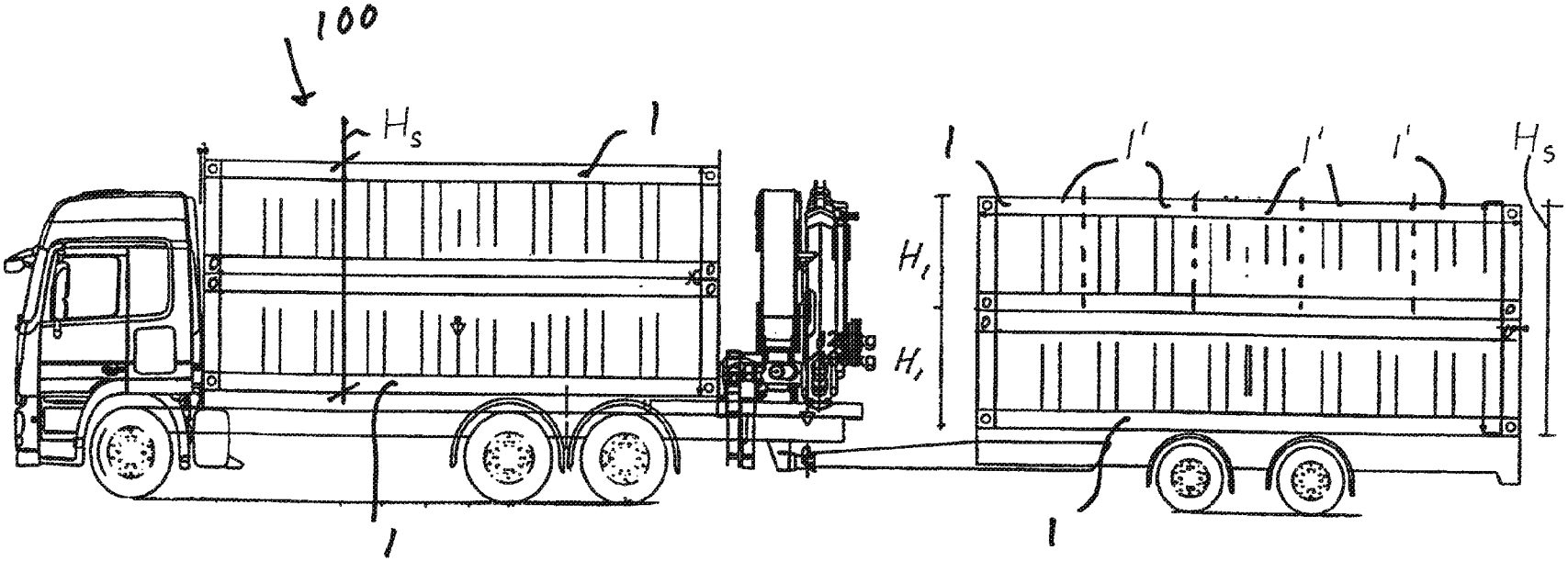
FIG. 7 shows a side view of an assembly of units according to the invention, during transportation.
Figure 8B:
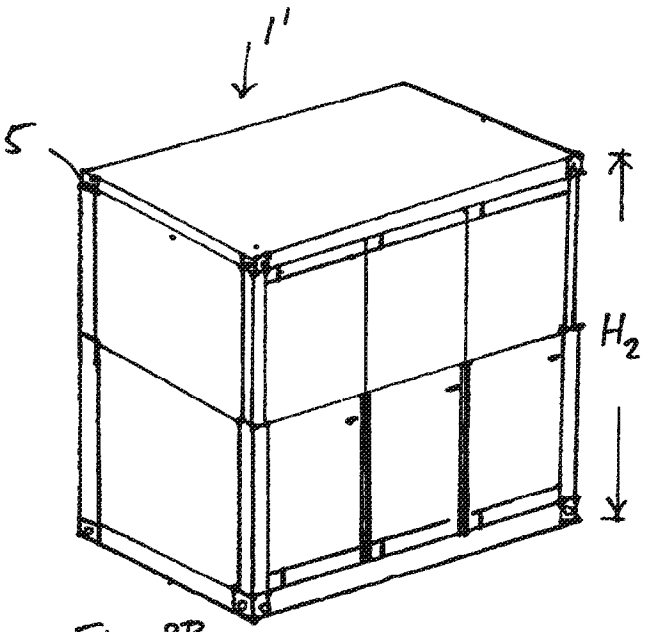
FIGS. 8A and 8B show a view of a smaller unit according to the invention, in the transport position and the operational position, respectively.
Figure 8A:
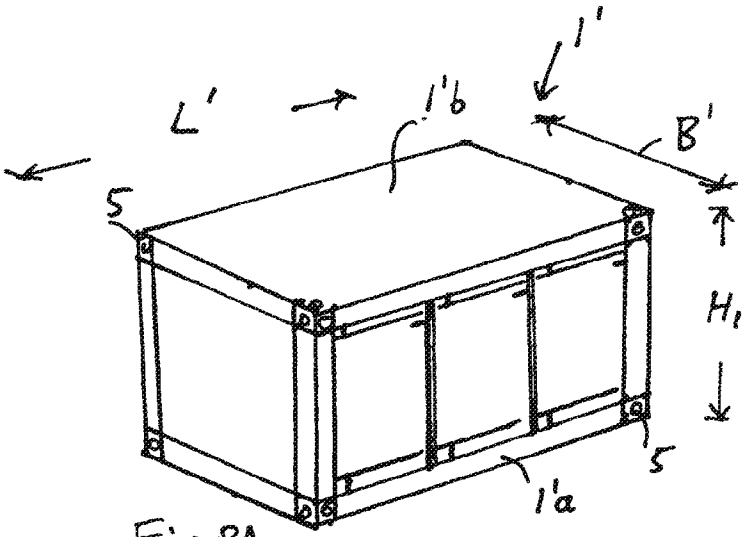

An assembly 100 of four units 1 can be transported by means of a truck with trailer, see FIG. 7, with units 1 according to the invention, wherein two stacked units each having height H1 together take up height Hs that equals a standard height of a standard container in this case 9 ft., 6 inches of a High Cube container.

Figure 10:
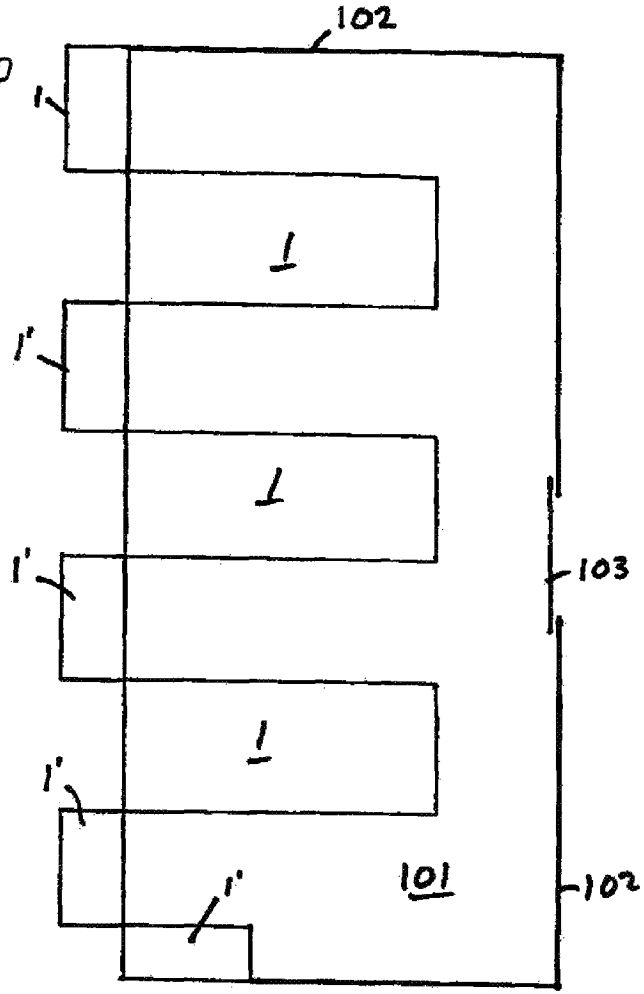
FIG. 10 shows a schematic top view of an arrangement of use with the assembly of units of FIG. 7.

It is also possible to transport a complete "sanitary village" with the truck combination of FIG. 7. Such a village is shown in FIG. 10, and comprises three sanitary units 1 and five smaller units 1' that can be converted from a transport position into an operational position in a manner comparable to units 1, see FIGS. 8A, 8B and FIGS. 9A-I, wherein in the transport position they have a height corresponding to H1 of units 1. In FIG. 7 said smaller units 1' are indicated with hatched lines. Just like the units 1, the units 1' are provided with the standard corner fittings 5 and they have an 8 ft. length L', equalling the width of the unit 1 and a width B' of an entire fraction of the length L of unit 1, in this case ⅕ thereof, 4 ft. The units 1' can be furnished as shower rooms, toilet rooms and/or urinal rooms, particularly with the said boxes, and in the shown set-up form a closure of the area 101 at the ends of the units 1. By means of the gate 102 an enclosed and controllable sanitary area 101 is thus provided, accessible through one closable entrance 103. The units 1, 1' can be connected to a vacuum drainage system by means of lines that are not shown.

Instead of doors window panels can also be used in both the upper section 1*b* and the lower section 1*a*. Entrance doors and inspection doors can be used in both the upper section and the lower section. Entrance doors that utilise the fully extended height are constructed so as to be retractable such that a proper operation in the extended position is guaranteed.

The frame of the unit can be made of steel or stainless material having sufficient strength to guarantee the functionality in the retracted and in the extended position. In the future new materials may be used if strength, price and weight provide a suitable balance for the purpose described herein.

If necessary special cross-connections in the construction can be used to strengthen the frame so that this construction complies with specific demands as regards the specific furnishing and function of the unit.

Retractable vertical (intermediate) columns that are not a part of the bearing structure can also be made of steel or stainless material. The part into which the other part slides will be designed stronger and larger than the part that slides in.

The walls and doors can be made of several materials, depending on the furnishing of the unit. The part sliding in can be made of lightweight, thin and strong material.

Providing intermediate walls of insulated sandwich panels is one of the options to protect the technical components against weather influences. In the resultative sub-space, protection against frost or air-conditioning can be applied.

In case the unit is furnished as a shower, urinal and/or toilet unit the floors can be mounted sloping inwardly inclined. Against a partition wall or rear wall, in the floor, drains can be mounted through which cleaning water and or rain water can drain away. This contributes to water not running out of the unit on the front side in front of the doors and thus affecting the condition of the soil, so that formation of mud in front of the entrance doors is limited.

The unit may among others be provided with a boiler system, water storage tanks, waste water tanks, generator sets, vacuum pumps etc.

Coupling all toilets, urinals, showers, washbasins and all other devices that produce waste water, can be effected by means of a waste water pipe system. This system passes the waste water to a vacuum pump that processes it and discharges it. As a result a high degree of hygiene is realised and this sanitary system also reduces the use of water to a high degree in comparison with a conventional toilet flushing system. However, placing standard sanitary fittings with drainage under the influence of gravity/head is also possible, or a combination thereof with a vacuum system.

On the inside the unit can be provided with lighting, particularly at the upper section 1*b*. If a battery or generator is present it will preferably be accommodated in lower section 1*a*. The connection with the fixtures can then take place through flexible lines that are capable of following the converting motion of the unit. Fixtures and lamps that are constructed so as to be lightweight are considered as much as possible in order to keep the overall weight of the unit as light as possible.

On the bottom corners the unit can be provided with one or more jack systems in order to set the unit horizontally or in any position.

The covering itself may me substantially shape-retaining, plate-shaped or flexible, such as cloth-shaped, if the covering itself will not be loaded with additional external weight. During transportation the covering cloth will be protected by the longitudinal girders 6*b* and the cross girders 7*b*.

The bottom and/or the covering can be provided with an extendable panel that may serve as step for the door panels or as shelter/sunscreen. These panels that can be slid out of the covering may be provided with lighting and or publication panels for information or advertising.

The examples given relate to the application of the residential space as a sanitary facility.

The unit according to the invention can be transported with standard transportation, by truck, train, barge, sea ship and is particularly transportation cost-effective and can be used worldwide. After transportation the unit is folded down and ready to be used within a few minutes.

It is not the object of the unit to transport commodities, such as piece goods. Only permanent furnishings that can be designed in many ways will inextricably be transported with the unit.

The above description is included to illustrate the operation of preferred embodiments of the invention and not to limit the scope of the invention. Starting from the above explanation many variations that fall within the spirit and scope of the present invention will be evident to an expert.

The invention claimed is:

1. A transportable unit for forming a straight parallelepiped-shaped residential space, comprising:

a bottom;

a covering;

outer walls; and upright inner walls, the upright inner walls extending in between the bottom and the covering, the upright inner walls being adapted to be converted between a retracted transport position and an extended operational position, in which the unit has a larger height, wherein the unit is equipped as a sanitary unit having a series of at least one of toilet bowls, urinals or showers, the bottom is part of a lower section of the unit and the covering is part of an upper section of the unit, which lower and upper sections can be moved in a vertical direction with respect to each other, said lower and upper sections having frames comprising longitudinal girders, transverse girders and columns meeting each other at corners of the unit, said columns having an upper column part attached to the upper section of the unit and a lower column part attached to the lower section of the unit, wherein the upper column part and the lower column part are slidable vertically into and out of each other or along each other by moving the upper and lower sections with respect to each other in said vertical direction and can be locked to each other in the extended operational position, the upright inner walls having an upper wall attached to the upper section of the unit and a lower wall attached to the lower section of the unit, wherein the upper wall and the lower wall of said upright inner walls are slidable vertically along each other by moving the upper and lower sections with respect to each other in said vertical direction, the upright inner walls shielding off sub-spaces in which the respective toilet bowls, urinals or showers are accommodated, the sub-spaces being directly accessible via entry sides of the sub-spaces, the entry sides of the sub-spaces being provided with respective individual doors for closing and opening the entry sides of the sub-spaces, said doors being provided in the outer walls of the unit, and in movement of the upper walls along the lower walls, the upper walls of the upright inner walls slide along the side of the lower walls facing away from the sub space concerned.

2. The transportable unit according to claim 1, wherein a common drain pipe for the toilet bowls, urinals or showers is incorporated in the bottom, wherein the drain pipe is adapted to be connected to a vacuum drainage system.

3. The transportable unit according to claim 1, wherein the sub-spaces in an operational position are formed by bays or niches, divided into an upper niche section and a lower niche section, that are attached to an upper section of the unit comprising the covering and a lower section of the unit comprising the bottom, respectively, the lower niche section and the upper niche section having upright wall sections that at conversion between the transport position and the operational position can be moved along or into each other.

4. The transportable unit according to claim 3, wherein the niches have been formed by pairs of boxes, namely an upper box and a lower box, each having an upright separation wall, which bounds the sub-space to two or three horizontal sides, namely to one or both sides of the sub-space and/or to the rear, away from the entrance of the sub-space in question, wherein both boxes are open on the entry side and on the upper and lower side, respectively, facing each other, and wherein the upper box is part of an upper section of the unit comprising the covering and the lower box is part of a lower section of the unit comprising the bottom, wherein the upper section and the lower section can be vertically moved with respect to each other.

5. The transportable unit according to claim 4, wherein the lower box comprises a bottom wall forming a surface for a user to stand on and/or the upper box comprises an upper wall in which a light fixture is disposed.

6. The transportable unit according to claim 4, wherein the upper boxes and the lower boxes are detachably attached to the frames of the upper section and the lower section of the unit, respectively.

7. The transportable unit according to claim 1, wherein the toilet bowls, urinals or shower heads are arranged in the lower section of the unit comprising the bottom.

8. The transportable unit according to claim 1, wherein the unit has half a standard height of a standard freight container, and an extended operational position, in which the unit has a larger height, wherein in the operational position the unit has a full standard height of a standard container, the standard height is the height of a 20 ft. TEU container, a 40 ft. TEU container or a 45 ft. High Cube container, and the length and width of the unit equal the length and width, respectively, of a 20 ft. TEU container, a 40 ft. TEU container or a 45 ft. High Cube container.

9. The transportable unit according to claim 1, provided with ISO corner fittings on the corners.

10. An assembly of a number of transportable units according to claim 1, wherein one unit has a length L corresponding with the standard length of a standard freight container and n units have a length L' corresponding with $1/n \times L$, wherein n is an integer.

11. The assembly according to claim 10 and a truck or trailer on which the transportable units have been placed.

12. The transportable unit according to claim 1, wherein the sub-spaces each have a urinal.

13. The transportable unit according to claim 1, wherein the sub-spaces each have a toilet bowl.

14. The transportable unit according to claim 1, wherein the sub-spaces each have a shower.

* * * * *